US008202117B2

(12) United States Patent
Pan

(10) Patent No.: US 8,202,117 B2
(45) Date of Patent: Jun. 19, 2012

(54) ELECTRICAL CONNECTOR HAVING REDUCED NUMBER OF SHIELDS

(75) Inventor: Feng Pan, Kunshan (CN)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 13/171,550

(22) Filed: Jun. 29, 2011

(65) Prior Publication Data

US 2012/0003872 A1 Jan. 5, 2012

(30) Foreign Application Priority Data

Jul. 3, 2010 (CN) ..... 2010 2 0246435

(51) Int. Cl.
*H01R 13/648* (2006.01)

(52) U.S. Cl. ..... 439/607.01

(58) Field of Classification Search ..... 439/607.01, 439/941, 79, 607.07, 885, 76.1
See application file for complete search history.

(56) References Cited

U.S. PATENT DOCUMENTS

| | | | | |
|---|---|---|---|---|
| 6,899,566 | B2 * | 5/2005 | Kline et al. | 439/607.56 |
| 7,381,092 | B2 * | 6/2008 | Nakada | 439/607.1 |
| 7,682,193 | B2 * | 3/2010 | Stoner | 439/607.07 |
| 2003/0119362 | A1 * | 6/2003 | Nelson et al. | 439/608 |
| 2003/0220019 | A1 * | 11/2003 | Billman et al. | 439/608 |
| 2009/0170373 | A1 | 7/2009 | Pan | |

* cited by examiner

*Primary Examiner* — Jean F Duverne
(74) *Attorney, Agent, or Firm* — Ming Chieh Chang; Wei Te Chung; Andrew C. Cheng

(57) ABSTRACT

An electrical connector (100) includes a first contact module (21), a second contact module (22), and a shielding plate (3) disposed adjacent to the second contact module. The first contact module includes a first insulative body (211) and a number of first contacts (212) mounted on the first insulative body. Each of the first contacts includes a first contact portion (213) extending beyond the first insulative body. The second contact module includes a second insulative body (221) and a number of second contacts (222) mounted on the second insulative body. Each of the second contacts includes a second contact portion (223) extending beyond the second insulative body. A shield plate is disposed adjacent to a side of the second contact module, and the first insulative housing is disposed adjacent to an opposite side of the second insulative housing. The electrical connector is devoid of shield between the first contact module and the second module.

11 Claims, 5 Drawing Sheets

ELECTRICAL CONNECTOR HAVING REDUCED NUMBER OF SHIELDS

BACKGROUND OF THE INVENTION

1. Field of the Invention

The present invention relates to an electrical connector, and more particularly to an electrical connector for communication applications.

2. Description of Related Arts

In communication applications, signal transmission speed becomes more and more high. Generally, electrical connector comprises inner and outer shielding plates to reduce crosstalk between the high speed signal transmitting channels. U.S. Patent publication No. 2009/0170373, published on Jul. 2, 2009, discloses a receptacle. According to the disclosure, the receptacle comprises a plurality of contact modules arranged side by side, and a plurality of shielding plates each disposed between a pair of adjacent contact modules. Each of the shielding plates comprises a body portion and a plurality of spring tabs extending from the body portion for mating with a mating connector. On the other hand, differential pair is widely used in high speed signal transmission. Therefore, the contacts of the electrical connector need be arranged suitably for transmitting differential signals. Each of the adjacent contact modules of the receptacle comprises one corresponding shielding plate. The number of shielding plates required is large and, therefore, the cost of manufacturing the receptacle is increased. Additionally, between adjacent contact modules, contacts cannot form differential pairs. The applications of the receptacle are restricted.

Hence, an improved electrical connector is desired to offer advantages over the related art.

SUMMARY OF THE INVENTION

An object of the present invention is to provide an electrical connector suitable for different applications and having low cost.

To achieve the above-mentioned object, An electrical connector includes a first contact module, a second contact module, and a shielding plate disposed adjacent to the second contact module. The first contact module includes a first insulative body and a plurality of first contacts mounted on the first insulative body. Each of the first contacts includes a first contact portion extending beyond the first insulative body. The first contacts are arranged on a first vertical plane. The second contact module includes a second insulative body and a plurality of second contacts mounted on the second insulative body. Each of the second contacts includes a second contact portion extending beyond the second insulative body. The second contacts are arranged on a second vertical plane spaced apart from the first vertical plane. A shield plate is disposed adjacent to a side of the second contact module. The first insulative housing is disposed adjacent to an opposite side of the second insulative housing. The electrical connector is devoid of shield between the first contact module and the second module.

According to the present invention, differential pairs could be formed by the first contacts or the second contacts. Additionally, the electrical connector is devoid of shield between the first insulative body and the second insulative body. Therefore, the cost of the electrical connector is decreased. Differential pairs could be formed by the first contacts and the second contacts. Therefore, the applications of the electrical connector are various.

DETAILED DESCRIPTION OF THE PREFERRED EMBODIMENT

Reference will now be made in detail to a preferred embodiment of the present invention.

Figure 1:
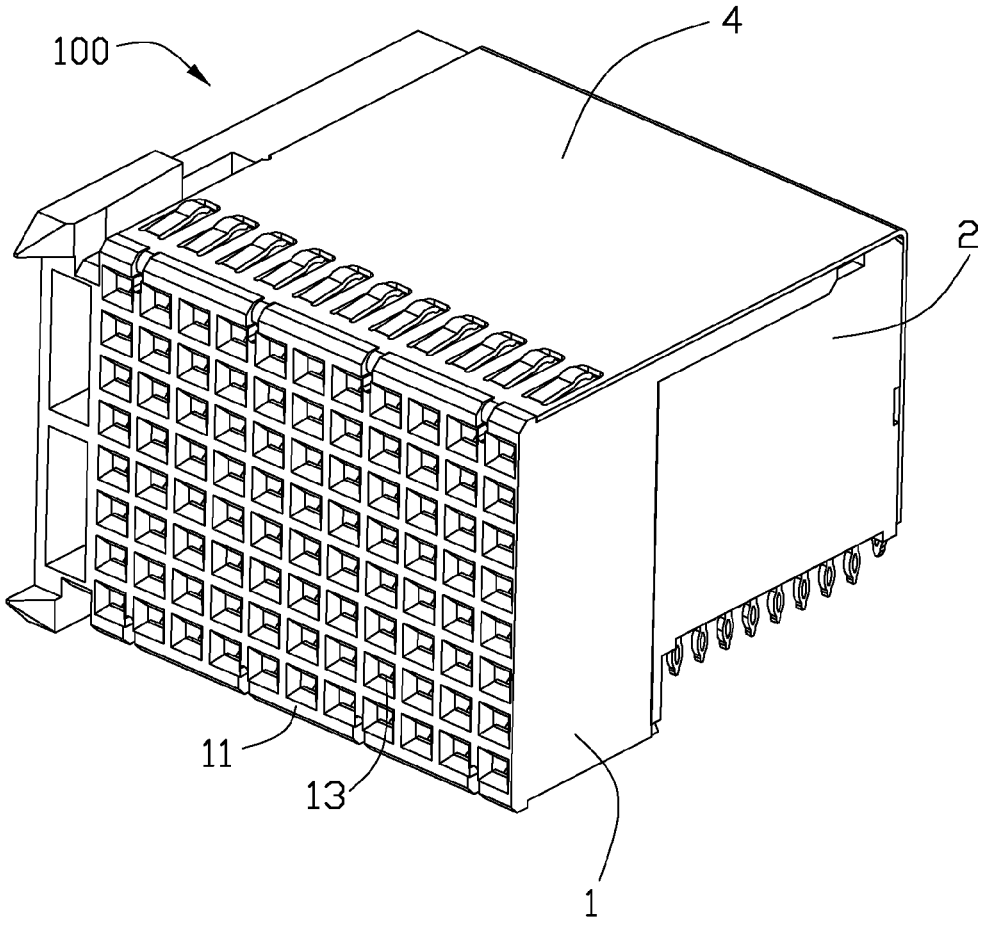
FIG. 1 is a perspective view of an electrical connector in accordance with the present invention.
Figure 2:
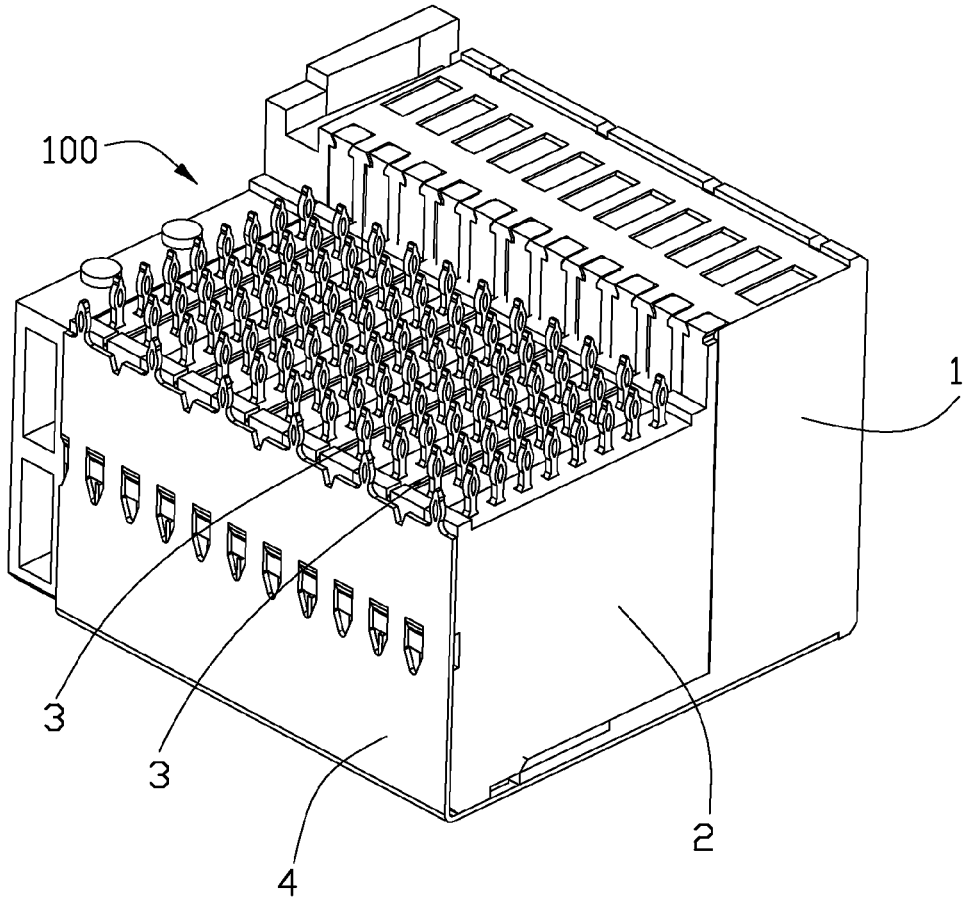
FIG. 2 is another perspective view of the electrical connector as shown in FIG. 1.
Figure 3:
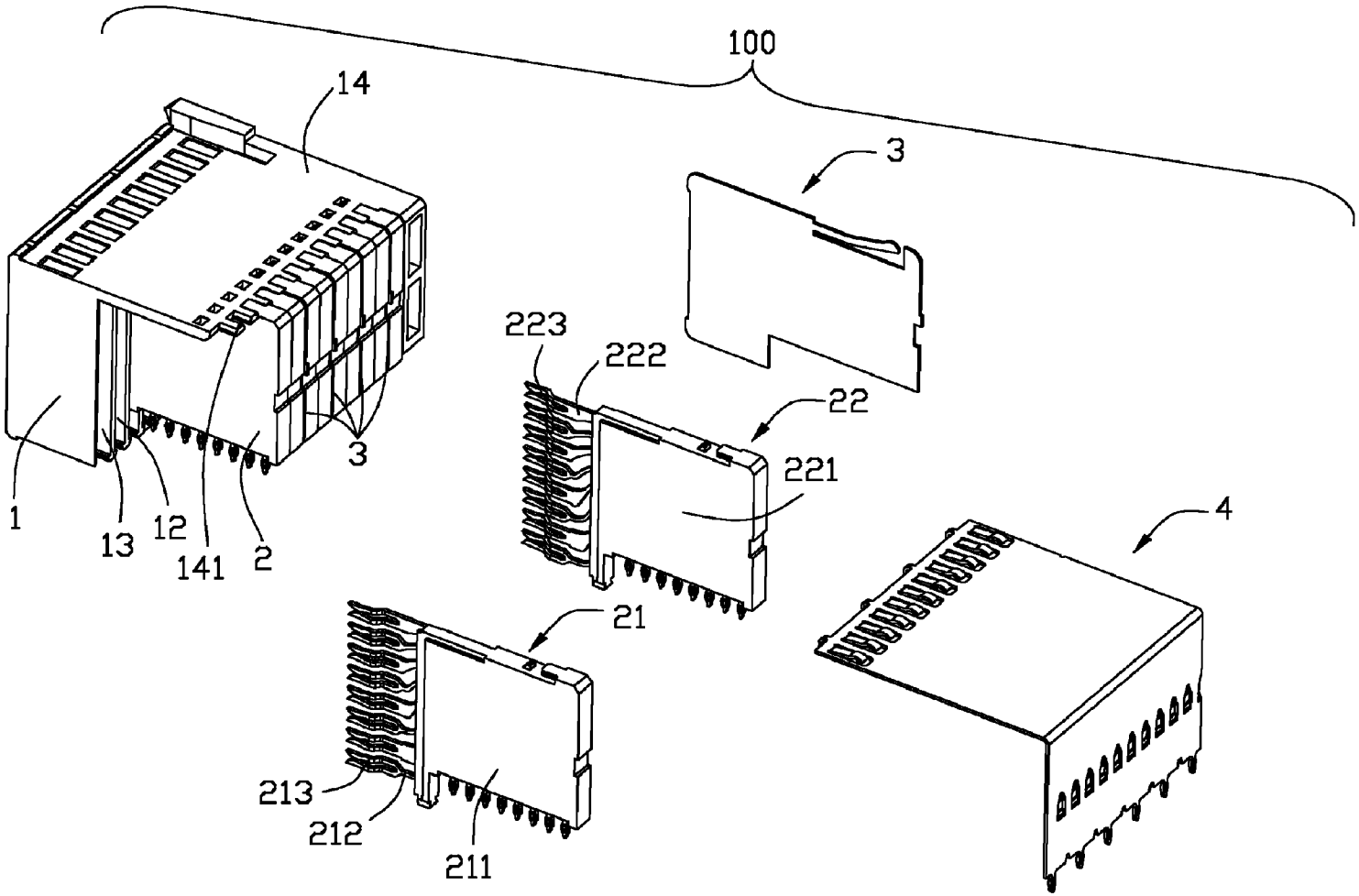
FIG. 3 is a partly exploded view of the electrical connector as shown in FIG. 1.

Referring to FIGS. 1 to 3, an electrical connector 100 comprises an insulative housing 1, a plurality of contact module assemblies 2 mounted on the insulative housing 1, a plurality of shielding plates 3 each disposed between every two adjacent contact module assemblies 2, and a shielding shell 4 covering the insulative housing 1.

Referring to FIGS. 1 to 3, the insulative housing 1 comprises a mating face 11, a mounting face 12, and a plurality of receiving cavities 13 extending through the mating face 11 and the mounting face 12. The insulative housing 1 comprises an top portion 14 disposed above the mating face 12 and extending along horizontal direction. The top portion 14 defines a plurality of slots 141 at an end of the top portion 14.

Referring to FIG. 3, each of the contact module assemblies 2 comprises a first contact module 21 and a second contact module 22 disposed side-by-side to the first contact module 21. Each of the shielding plates 3 is disposed on a side of corresponding second contact module 22, and the corresponding first contact module 21 is disposed on an opposite side of the second contact module 22. Each of the first contact modules 21 comprises a first insulative body 211 latched with the slot 141, and a plurality of first contacts 212 mounted on the first insulative body 211. Each of the first contacts 212 comprises a first mating portion 213 extending beyond the first insulative body 211 and received in the receiving cavity 13. The first contacts 212 of the first contact module 21 are disposed on the first vertical plane. Each of the second contact modules 22 comprises a second insulative body 221 latched with the slot 141, and a plurality of second contacts 222 mounted on the second insulative body 211. Each of the second contacts 222 comprises a second mating portion 223 extending beyond the second insulative body 221 and received in the receiving cavity 13. The second contacts 222 of the second contact module 22 are disposed on a second vertical plane spaced apart from the first vertical plane. Each of the first insulative body 21 is disposed adjacent to a corresponding second insulative body 22. The first mating portion 213 and the second mating portion 223 have a bifurcate shape. The first mating portions 213 are disposed symmetrically with the second contact portions 223 along an imaginary vertical plane disposed between a middle of the first insulative body 211 and the second insulative body 221. The first mating portions 213 extend away from the imaginary vertical plane along a first direction, and the second mating portions 223 extend away from the imaginary vertical plane along a second direction opposite to the first direction.

Figure 4:
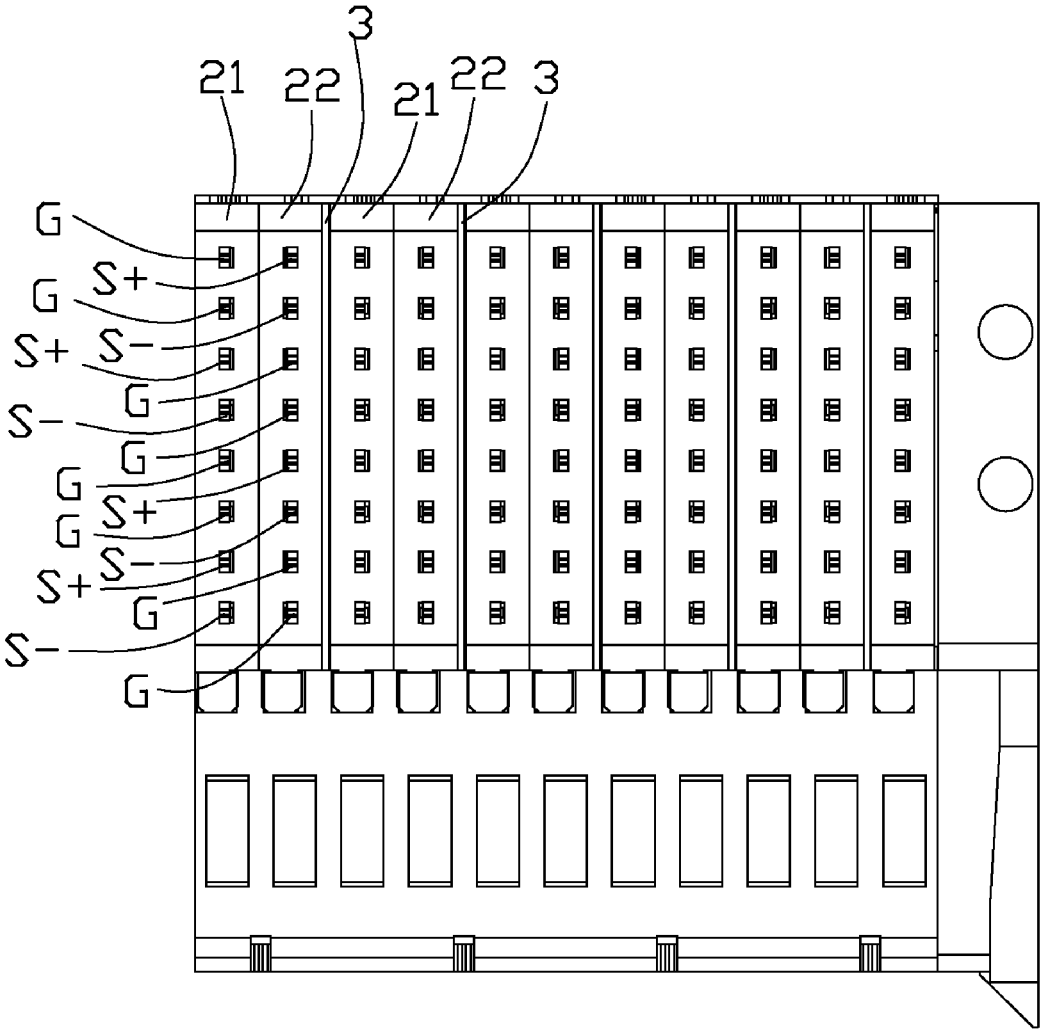
FIG. 4 is a bottom view of the electrical connector as shown in FIG. 1 showing the contacts arranged in a first fashion.

Referring to FIG. 4, the first contacts 212 of each of the first contact modules 21 comprise two adjacent first contacts 212 being defined as a first differential pairs S+, S−, two first contacts 212 being defined as grounding contacts G, G disposed on opposite sides of the pair of the first differential pairs respectively. The second contacts 222 of each of the second contact modules 22 could be arranged to second differential pairs S+, S−, and a pair of ground contacts G, G each disposed on opposite sides of each of the second differential pairs respectively. In order to decrease the crosstalk between the first differential pairs and the second differential pairs, the first differential pairs are offset to the second differential pairs along vertical direction.

Figure 5:
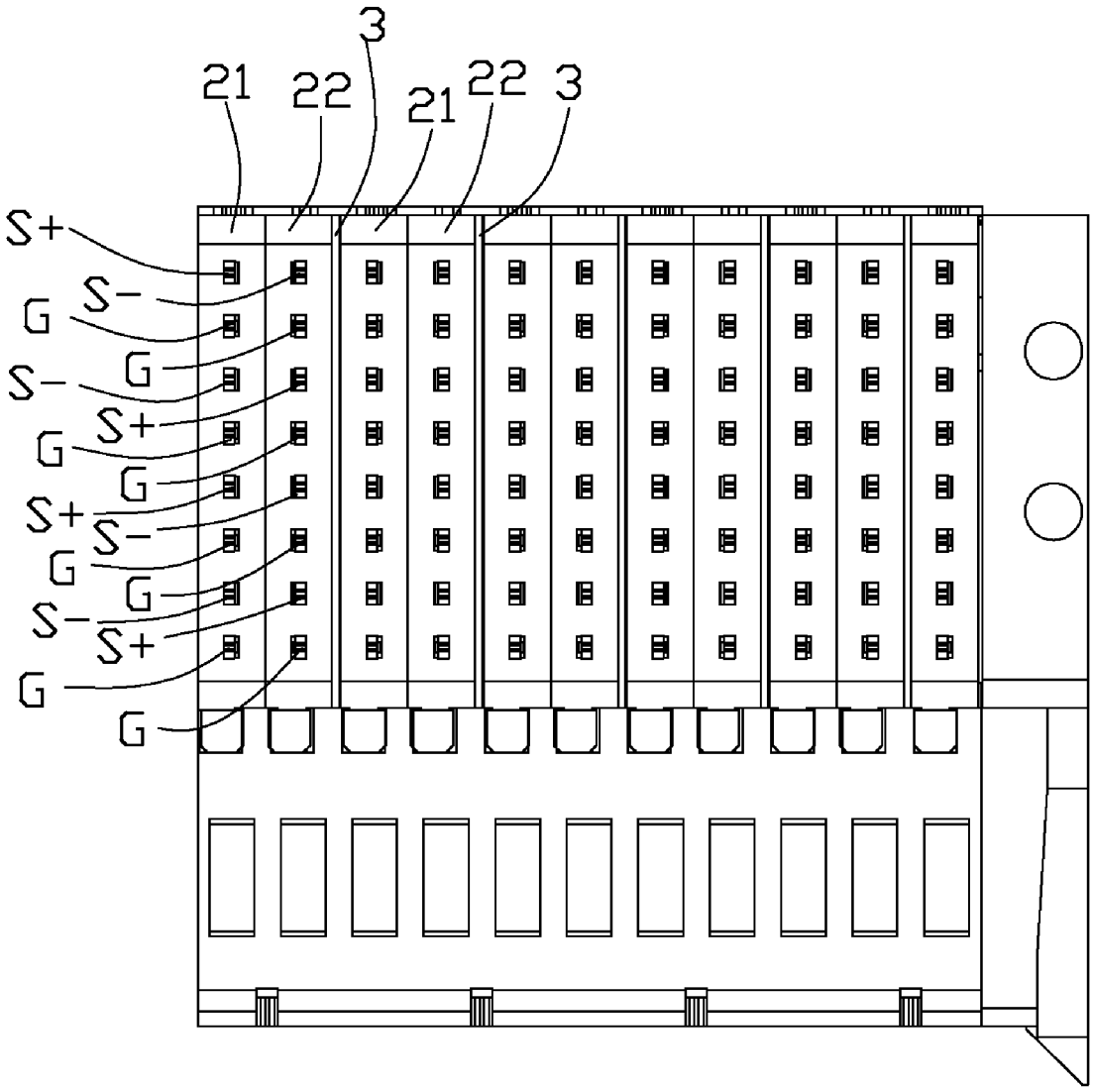
FIG. 5 is a bottom view of the electrical connector as shown in FIG. 1 showing the contacts arranged in a second fashion.

Referring to FIG. 5, the first contacts 212 and the second contacts 222 of each of the contact module assemblies 2 could be arrange to another fashion distinct to the fashion shown in FIG. 4. The electrical connector 100 is devoid of shield between the first contact module 21 and the second contact module 22 of each of the contact module assemblies 2. Therefore, some of the first contacts 212 and corresponding second contacts 222 aligned with the first contacts 212 of each contact module assembly 2 cooperate to form third differential pairs S+, S− and fourth differential pairs S+, S−. The third differential pairs are aligned with the fourth differential pairs along vertical direction.

Referring to FIG. 3, each of the shielding plates 3 has a flat shape and disposed in vertical plane. Each of the shielding plate 3 is devoid of mounting leg for mounting to a PCB (print circuit board), and comprises mating portion (not labeled) for mating with a mating connector. The structure of the shielding plates 3 is simple and easy to manufacture. The electrical connector 100 is devoid of shields between the first contact module 21 and the second contact module 22 of each of the contact module assemblies 2. Therefore, a mass of metallic material is saved.

Referring to FIGS. 1 to 5, the first contacts 212 of each of the first contact module 21 could be arranged to first differential pairs S+, S−. Similarly, the second contacts 222 of each of the second contact module 22 could be arranged to second differential pairs S+, S−. Additionally, some of the first contacts 212 and corresponding second contacts 222 of each of the contact module assemblies 2 could be arranged to third differential pairs S+, S− and fourth differential pairs S+, S−. Therefore, the applications of the electrical connector 100 are various.

It is to be understood, however, that even though numerous characteristics and advanarmes of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

a first contact module comprising a first insulative body and a plurality of first contacts mounted on the first insulative body, each of the first contacts comprising a first contact portion extending beyond the first insulative body, the first contacts being arranged on a first vertical plane;

a second contact module comprising a second insulative body and a plurality of second contacts mounted on the second insulative body, each of the second contacts comprising a second contact portion extending beyond the second insulative body, the second contacts being arranged on a second vertical plane spaced apart from the first vertical plane; and a shield plate disposed adjacent to a side of the second contact module;

wherein the first insulative housing disposed adjacent to an opposite side of the second insulative housing;

wherein the electrical connector is devoid of shield between the first contact module and the second contact module;

wherein the first contact module comprises at least one first differential pair constituted by a pair of said first contacts disposed adjacent to each other along a vertical direction;

wherein the second contact module comprises at least one second differential pair constituted by a pair of said second contacts disposed adjacent to each other along the vertical direction;

wherein the at least one first differential pair and the at least one second differential pair are offset along the vertical direction.

2. The electrical connector as recited in claim 1, wherein one of the first contacts and one of the second contacts are aligned with each other along a horizontal direction to form one differential pair.

3. The electrical connector as recited in claim 2, wherein another one of the first contacts and another one of the second contacts are aligned with each other along the horizontal direction to form another differential pair.

4. The electrical connector as recited in claim 3, wherein, between the one differential pair and the another differential pair, a ground pair is provided.

5. The electrical connector as recited in claim 1, wherein the first contact portions are disposed symmetrically with the second contact portions along an imaginary vertical plane defined between a middle of the first insulative body and the second insulative body.

6. The electrical connector as recited in claim 5, wherein each of the first contact portions and the second contact portions has a bifurcate shape and extends away from the imaginary vertical plane.

7. The electrical connector as recited in claim 1, wherein the shield plate has a flat shape and is disposed in an imaginary vertical plane.

8. The electrical connector as recited in claim 1, wherein the shield plate is devoid of mounting leg for mounting to a printed circuit board and comprises a mating portion for mating with a mating connector.

9. An electrical connector comprising:

a plurality of first contact modules and a plurality of second contact modules alternately arranged with each other in a transverse direction while each of said first contact modules and that of said second contact modules extends in a vertical direction and a horizontal direction perpendicular to each other and further to said transverse direction;

each of said first contact modules defining a first insulator enclosing a plurality of first contacts with first contacting sections and first mounting sections exposed to an exterior, said first contacts including first differential pairs and first grounding contacts;

each of said second contact modules defining a second insulator enclosing a plurality of second contacts with second contacting sections and second mounting sections exposed to the exterior, said second contacts including second differential pairs and second grounding contacts;

each of said first contact modules cooperating with one corresponding second contact module to commonly form a set of contact modules without any shield therebetween while a plurality of shields separating different sets of the contact modules, respectively; wherein in each set of contact modules, the first differential pair of the first contact module are aligned with the corresponding two second grounding contacts of the second contact module in the transverse direction, and the two first grounding contacts of the first contact module are aligned with the corresponding second differential pair of the second contact module in said transverse direction; wherein in the first contact module, the first differential pairs and every two first grounding contacts are alternately arranged with each other in the vertical direction, and similarly, in the second contact module, the second differential pairs and every two second grounding contacts are alternately arranged with each other in the vertical direction.

10. An electrical connector comprising:

a plurality of differential pairs and a plurality of grounding contacts arranged with each other in matrix;

said differential pairs and said grounding contacts including a same amount with each other;

said differential pairs and said grounding contacts being arranged in corresponding first and second contact modules in either first or second way under condition that the first and second contact modules are alternately arranged with each other in a transverse direction and each of said first contact modules and that of said second contact modules extends in a vertical direction and a horizontal direction perpendicular to each other and further to said transverse direction; wherein in the first way, each differential pair is formed on the same one of said first contact module and said second contact module, and there are two of said grounding contacts neighboring said differential pair in the horizontal direction in said same one of the first contact module and said second contact module and further other two of said grounding contacts neighboring said differential pair in the transverse direction in the other of said first contact module and said second contact module;

in the second way, each differential pair are respectively located in the adjacent first and second contact modules in the transverse direction, and there is one pair of grounding contacts neighboring said differential pair in the horizontal direction and respectively located in said adjacent first and second contact modules in the transverse direction, and there are another differential pair neighboring the pair of grounding contacts in the horizontal direction and respectively located in said adjacent first and second contact modules in the transverse direction under condition that the differential pair in the first contact module and said another differential pair in the first module, which are respectively located by two sides of the corresponding grounding contact in the horizontal direction, are electrically opposite to each other, and the differential pair in the second contact module and said another differential pair in the second module, which are respectively located by two sides of the corresponding grounding contact in the horizontal direction, are electrically opposite to each other.

11. The electrical connector as claimed in claim 10, wherein said first and second contact modules are arranged in pairs, and each pair is isolated from the neighboring two pairs of contact modules by two sides via a pair of shields, respectively.

* * * * *